US009878196B2

(12) United States Patent
Lin

(10) Patent No.: US 9,878,196 B2
(45) Date of Patent: Jan. 30, 2018

(54) BATHTUB EXERCISE AUXILIARY APPARATUS

(71) Applicant: Chung-Pao Lin, Taichung (TW)

(72) Inventor: Chung-Pao Lin, Taichung (TW)

( * ) Notice: Subject to any disclaimer, the term of this patent is extended or adjusted under 35 U.S.C. 154(b) by 328 days.

(21) Appl. No.: 14/285,472

(22) Filed: May 22, 2014

(65) Prior Publication Data

US 2014/0250582 A1 Sep. 11, 2014

Related U.S. Application Data

(63) Continuation-in-part of application No. 13/358,999, filed on Jan. 26, 2012, now abandoned.

(51) Int. Cl.

| | |
|---|---|
| ***A61H 33/02*** | (2006.01) |
| ***A63B 21/16*** | (2006.01) |
| ***A61H 33/00*** | (2006.01) |
| ***A63B 3/00*** | (2006.01) |
| ***A63B 17/04*** | (2006.01) |
| ***A63B 21/02*** | (2006.01) |
| ***A63B 21/04*** | (2006.01) |
| ***A63B 23/035*** | (2006.01) |
| ***A63B 23/12*** | (2006.01) |
| *A63B 69/00* | (2006.01) |
| *A63B 21/068* | (2006.01) |

(Continued)

(52) U.S. Cl.

CPC ..... *A63B 21/16* (2013.01); *A61H 33/6005* (2013.01); *A63B 3/00* (2013.01); *A63B 17/04* (2013.01); *A63B 21/025* (2013.01); *A63B 21/0442* (2013.01); *A63B 23/03541* (2013.01); *A63B 23/1209* (2013.01); *A63B 21/00181* (2013.01); *A63B 21/068* (2013.01); *A63B 69/0057* (2013.01); *A63B 2023/0411* (2013.01); *A63B 2208/03* (2013.01)

(58) Field of Classification Search

USPC ..... 4/546

See application file for complete search history.

(56) References Cited

U.S. PATENT DOCUMENTS 4,776,581 A * 10/1988 Shepherdson ..... A63B 5/11 4/493

5,308,296 A * 5/1994 Eckstein ..... A63B 22/0056 434/307 R (Continued)

*Primary Examiner* — Lauren Crane

(74) *Attorney, Agent, or Firm* — Bruce Stone LLP

(57) ABSTRACT

A bathtub exercise auxiliary apparatus includes: a first support, a bathtub, a second support, a traction unit and an exercise rack. The first support includes a plurality of base rods, traverse rods, longitudinal support rods, and longitudinal assembling rods. The bathtub is disposed in the first support and includes a trough and a plurality of housing portions. The second support is removably fixed to the first support, located above the bathtub, and includes a plurality of longitudinal connecting rods fixed to the longitudinal assembling rods, two parallel traverse connecting rods connected to the longitudinal connecting rods, two traverse rods connected between the longitudinal connecting rods, and two longitudinal rods connected to the traverse rods. The traction unit is disposed at the connections of the longitudinal rods and the traverse rods. The exercise rack is disposed between the traverse connecting rods, bridges over the trough, and includes a griping portion.

6 Claims, 8 Drawing Sheets

(51) Int. Cl.
*A63B 23/04* (2006.01)
*A63B 21/00* (2006.01)

(56) References Cited

U.S. PATENT DOCUMENTS 5,554,091 A * 9/1996 Patey ..... A63B 21/4011 4/577.1
8,177,087 B2 * 5/2012 Noble ..... B08B 17/00 220/666
2011/0162136 A1 * 7/2011 Chen ..... A63B 71/00 4/494

* cited by examiner

BATHTUB EXERCISE AUXILIARY APPARATUS

This application is a continuation in part of U.S. patent application Ser. No. 13/358,999, which claims the benefit of the earlier filing date of Jan. 26, 2012.

BACKGROUND OF THE INVENTION

Field of the Invention

The present invention relates to an exercise auxiliary apparatus, and more particularly to a bathtub exercise auxiliary apparatus.

Description of the Prior Art

Aquatic therapy is a technique to relax user's body or provide muscle therapy. These days SPA is very popular that aims to stimulate blood circulation of users via warm water and improve metabolism. Some use the pressure of ejecting water to thrust selected portions of user's body to massage the muscles. Aquatic rehabilitation is another type of aquatic therapy. For instance, swimming is generally deemed a desirable exercise that can enhance muscle control and resilience. Swimming, incorporating with respiration in the water, can thrust user's body moving in the water to train coordination capability of the body. Clinical reports show that the buoyancy in the water can facilitate various types of rehabilitation without much stress and alleviate undesirable effects on other portions of the body. However, not everyone can swim. Moreover, for people who are undergoing rehabilitation from serious muscle injury, swimming is too difficult and not very practical.

In addition, swimming pools generally are open to public and accessible by many people. For people who are undergoing rehabilitation, swimming in such locations creates unnecessary exposure and could cause mental uneasiness and result in ill effect to rehabilitation, thus make people in need reluctant to do rehabilitation in the swimming pool. Furthermore, rehabilitative exercises doable in the swimming pool are limited and confined by the site, and special equipments or facilities cannot be deployed as desired to meet users' requirements.

The present invention has arisen to mitigate and/or obviate the afore-described disadvantages.

SUMMARY OF THE INVENTION

The primary objective of the present invention is to provide a bathtub exercise auxiliary apparatus which is easy to assemble and maintenance.

Another objective of the present invention is to provide a bathtub exercise auxiliary apparatus capable of improving effectiveness of rehabilitation and avoid sports injuries.

To achieve the above objectives, a bathtub exercise auxiliary apparatus in accordance with the present invention comprises: a first support, a bathtub, a second support, at least one traction unit and an exercise rack. The first support includes a plurality of base rods, a plurality of traverse rods, a plurality of longitudinal support rods disposed between the base rods and the traverse rods, and a plurality of longitudinal assembling rods connected to the longitudinal support rods. The bathtub is disposed in the first support and includes a trough and a plurality of housing portions, and the longitudinal assembling rods protruding out of the housing portions. The second support is removably fixed to the first support, located above the bathtub, and includes a plurality of longitudinal connecting rods fixed to the longitudinal assembling rods, two parallel and spaced apart traverse connecting rods connected to the longitudinal connecting rods, two traverse rods connected between the longitudinal connecting rods, and two longitudinal rods connected to the traverse rods. The at least one traction unit for being pulled by the user is disposed at connections of the longitudinal rods and the traverse rods. The exercise rack is disposed between the traverse connecting rods of the second support, bridges over the trough, and includes a griping portion.

Preferably, each of the longitudinal connecting rods of the second support includes an engaging groove for engaging with the longitudinal rods.

Preferably, the bathtub exercise auxiliary apparatus further comprises a screw and a nut, and the screw has a head portion pressed against the longitudinal connecting rod and a shaft portion inserted through the longitudinal connecting rod, the engaging groove, and the longitudinal assembling rod and then screwed with the nut.

Preferably, an annular pressing portion is formed at a bottom of each of the longitudinal connecting rods of the second support to press against the housing portions of the bathtub.

Preferably, the housing portions press against the traverse rods.

Preferably, the exercise rack is movably disposed between the two traverse connecting rods of the second support and includes two positioning units for clamping and releasing the two traverse connecting rods, when the positioning units release the traverse connecting rods, the exercise rack will be free to move along the two traverse connecting rods, and when the positioning units clamp the traverse connecting rods, the exercise rack will be fixed on the two traverse connecting rods.

Preferably, the positioning units each include a traverse positioning portion for abutting against the top of the traverse connecting rods, and two lateral positioning portions connected to the traverse positioning portion and located at two sides of a corresponding one of the traverse connecting rods, the two traverse positioning portions are able to move toward each other to clamp the traverse connecting rods, or move away from each other to release the traverse connecting rods, each of the positioning units further includes a screw and a nut, and the screw has a head portion pressed against one of the lateral positioning portions and a shaft portion inserted through the two lateral positioning portions and then screwed with the nut.

Preferably, the two traction units each include an engaging portion for engaging with the connection of the longitudinal rods and the traverse rods, a spring connected to the engaging portion, and a handle connected to the spring.

Preferably, the bathtub exercise auxiliary apparatus further comprises a screen disposed on the longitudinal rods and the traverse rods.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
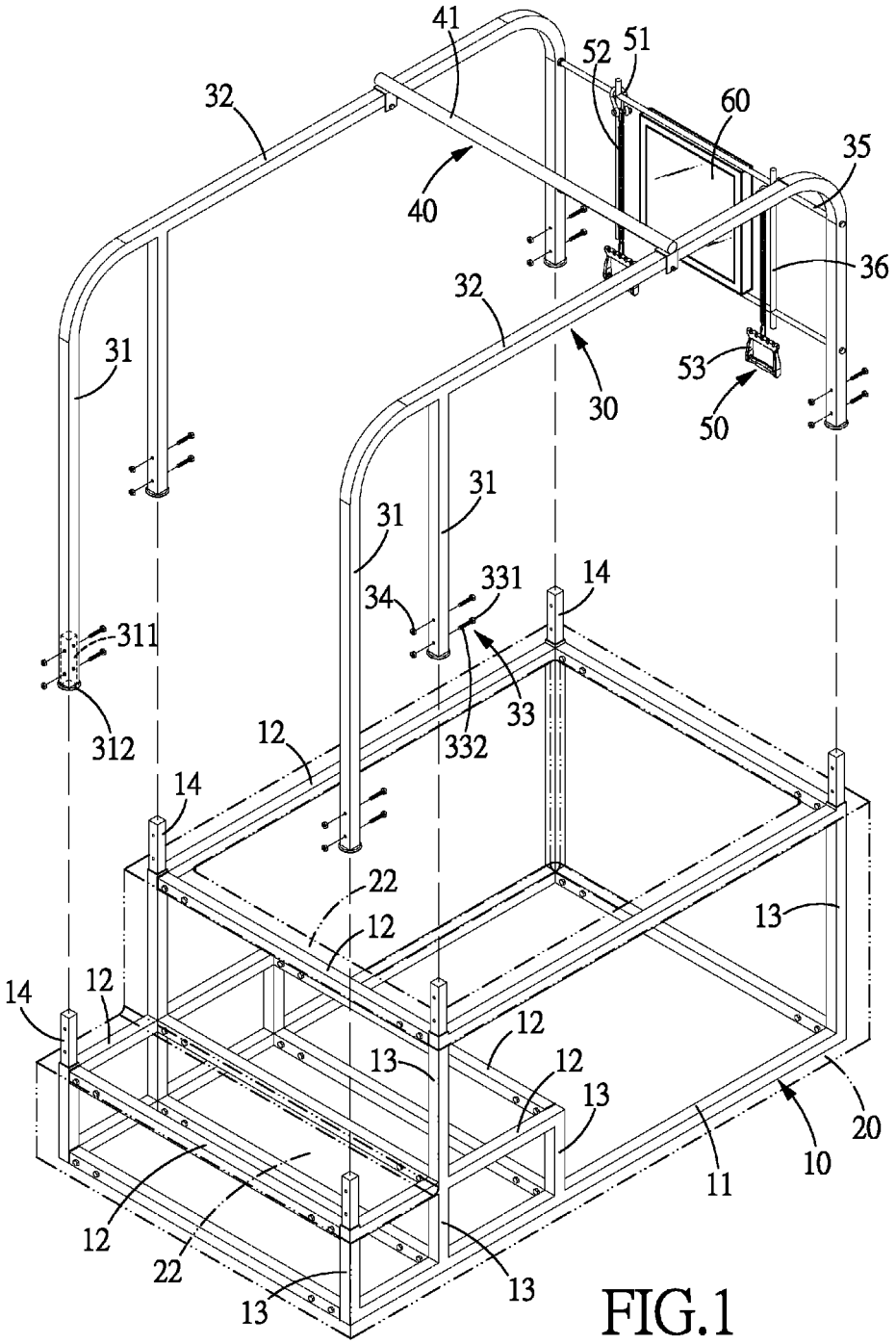
FIG. 1 is a perspective view of a bathtub exercise auxiliary apparatus in accordance with a first embodiment of the present invention.
Figure 2:
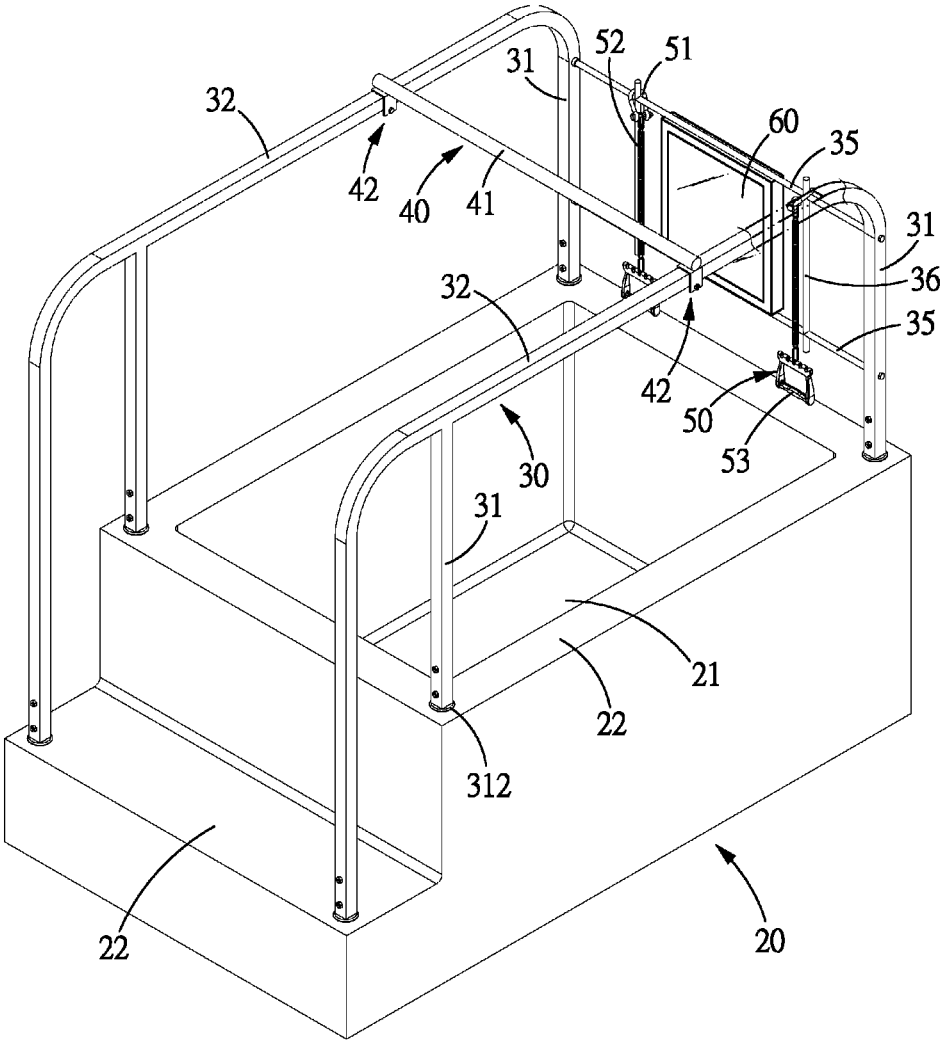
FIG. 2 is an assembly view of the bathtub exercise auxiliary apparatus in accordance with the first embodiment of the present invention.
Figure 3:
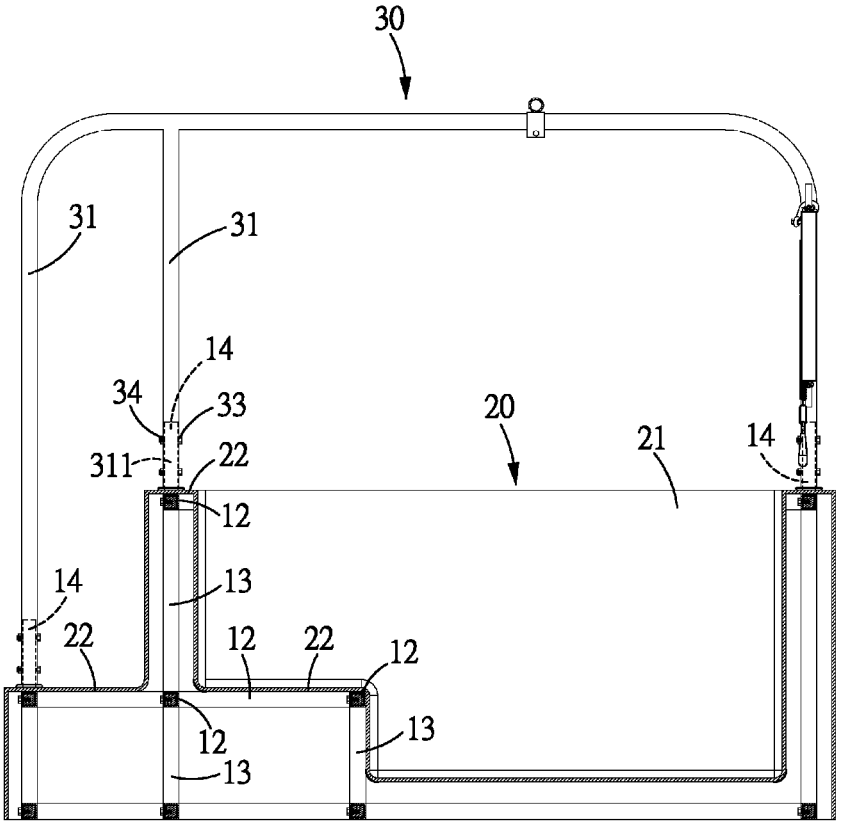
FIG. 3 is a cross sectional view of the bathtub exercise auxiliary apparatus in accordance with the first embodiment of the present invention.

Referring to FIGS. 1-3, a bathtub exercise auxiliary apparatus in accordance with a first embodiment of the present invention comprises: a first support 10, a bathtub 20, a second support 30, an exercise rack 40, two traction units 50, and a screen 60.

The first support 10 includes a plurality of base rods 11, a plurality of traverse support rods 12, a plurality of longitudinal support rods 13 disposed between the base rods 11 and the traverse support rods 12, and a plurality of longitudinal assembling rods 14 connected to the longitudinal support rods 13.

The bathtub 20 covers the first support 10 and includes a trough 21 for holding water and a plurality of housing portions 22 for pressing against the traverse support rods 12, and the longitudinal assembling rods 14 protrude out of and upwardly extend from the housing portions 22. In this embodiment, the housing portions 22 located inside the trough 21 is a sit portion for the user to step or sit on, so that the user can do stepping exercise to strengthen the quadriceps by stepping on the sit portion, or by using buoyancy aid, the user can sit on the sit portion to strengthen the abductors and relieve pain by outstretching and retracting legs. The housing portions 22 located outside the trough 21 can be a step portion for the user to get into the trough 21 by stepping on the step portion.

The second support 30 is removably fixed to the first support 10, located above the bathtub 20, and includes a plurality of longitudinal connecting rods 31 fixed to the longitudinal assembling rods 14, two parallel and spaced apart traverse connecting rods 32 connected to the longitudinal connecting rods 31, two traverse rods 35 connected between the longitudinal connecting rods 31, and two longitudinal rods 36 connecting the traverse rods 35. In this embodiment, each of the longitudinal connecting rods 31 of the second support 30 includes an engaging groove 311 for engaging with the longitudinal assembling rods 14, and is provided at a bottom thereof with an annular pressing portion 312 for pressing against the surface of the housing portions 22 of the bathtub 20. Each of the longitudinal connecting rods 31 of the second support 30 is sleeved onto a corresponding one of the longitudinal assembling rods 14 of the first support 10 and fixed thereon by a screw 33 and a nut 34, in such a manner that the screw 33 has a head portion 331 pressed against the longitudinal connecting rod 31 and a shaft portion 332 inserted through the longitudinal connecting rod 31, the engaging groove 311, and the longitudinal assembling rod 14 and then screwed with the nut 34. It is to be noted that the base rods 11, the base rods 11, the traverse support rods 12, the longitudinal support rods 13 and the longitudinal assembling rods 14 of the first support 10 are removably assembled together in the same manner as the first and second supports 10, 30 are assembled.

The exercise rack 40 is disposed between the traverse connecting rods 32 of the second support 30, bridges over the trough 21, and includes a griping portion 41, so that the user can hang from the exercise rack 40 to train arms and rehabilitate spine by griping the gripping portion 41, which also strengthens the paraspinal muscles. The use of the exercise rack 40 and the water buoyancy can maintain the spine in a correct position, which prevents kyphosis, scoliosis, and relive pain.

The two traction units 50 for being pulled by the user are disposed at the connections of the longitudinal rods 36 and the traverse rods 35, and each include an engaging portion 51 for engaging with the connection of the longitudinal rods 36 and the traverse rods 35, a spring 52 connected to the engaging portion 51, and a handle 53 connected to the spring 52.

The screen 60 is disposed on the longitudinal rods 36 and the traverse rods 35 to play teaching videos when the user is doing exercise to improve the effectiveness of rehabilitation and avoid sports injuries.

Figure 4:
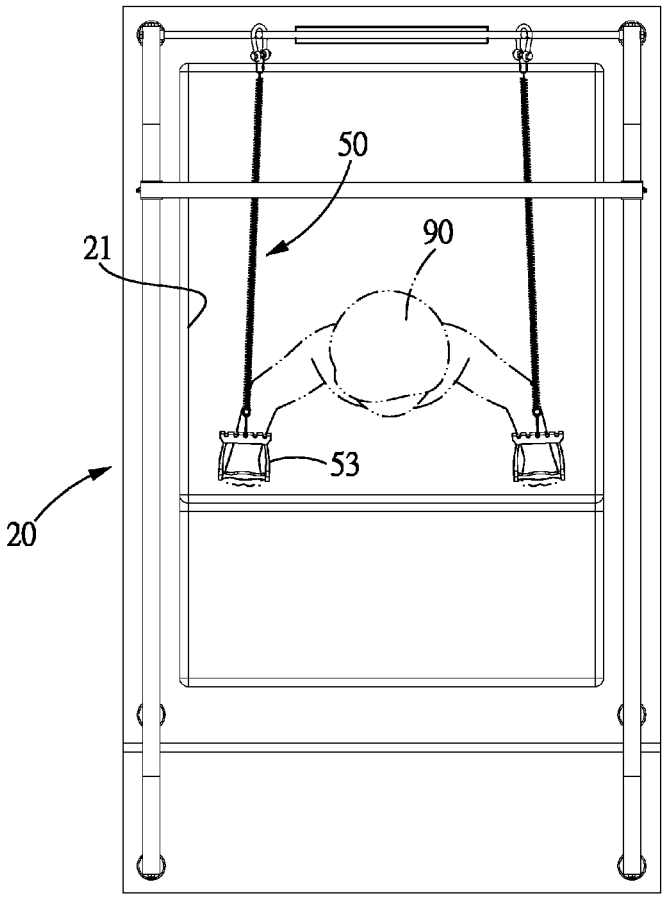
FIG. 4 is a first operational view of the bathtub exercise auxiliary apparatus in accordance with the first embodiment of the present invention.
Figure 5:
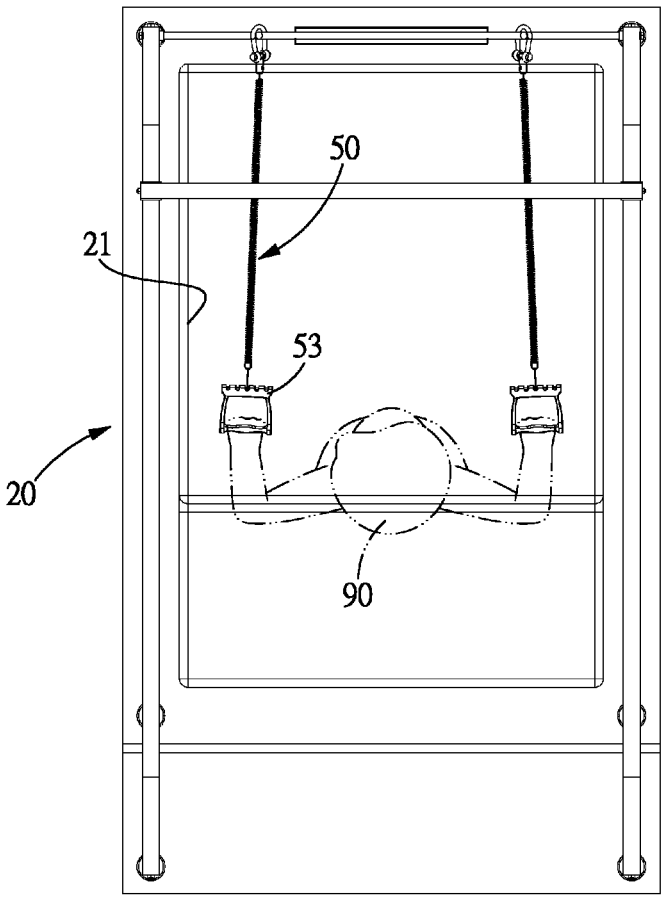
FIG. 5 is a second operational view of the bathtub exercise auxiliary apparatus in accordance with the first embodiment of the present invention.

Referring then to FIGS. 4 and 5, the user 90 can stand in the trough 21 of the bathtub 20 full of water, facing or with back turned to the traction units 50, and stretches arms by pulling the handles 53, so as to train to core muscles. During the exercise, the screen 60 can play teaching videos to improve the effectiveness of rehabilitation and avoid sports injuries.

The arrangement of the housing portions 22 in the form of step portions outside the bathtub 21 and the longitudinal connecting rods 31 of the second support 30 makes it easier for the user to get into the bathtub 21. The user can wear life belt and buoyancy dumbbells, when doing exercise, for sake of safety and enhancing effectiveness of rehabilitation.

Since the first and second supports 10, 30 are removably assembled together and can be disassembled before moving into the installation space (the bathroom), so that the first and second supports 10, 30, the bathtub 20, and the exercise rack 40 can be moved separately into the installation space and then assembled together, which makes it easier for assembly and maintenance.

The first support 10 includes the traverse support rods 12 and longitudinal support rods 13, and the bathtub 20 is disposed on the first support 10 and includes the housing portions 22 for pressing against the traverse support rods 12, and the longitudinal connecting rods 31 of the second support 30 are fixed to the longitudinal assembling rods 14. Therefore, in addition to the fact that the first support 10 is provided for mounting of the second support 30, preventing the direction mounting of the second support 30 onto the bathtub 20 and causing damage to the bathtub 20, the traverse support rods 12 of the first support 10 are also provided for supporting of the bathtub 20, improving the structural strength of the bathtub 20.

Figure 6:
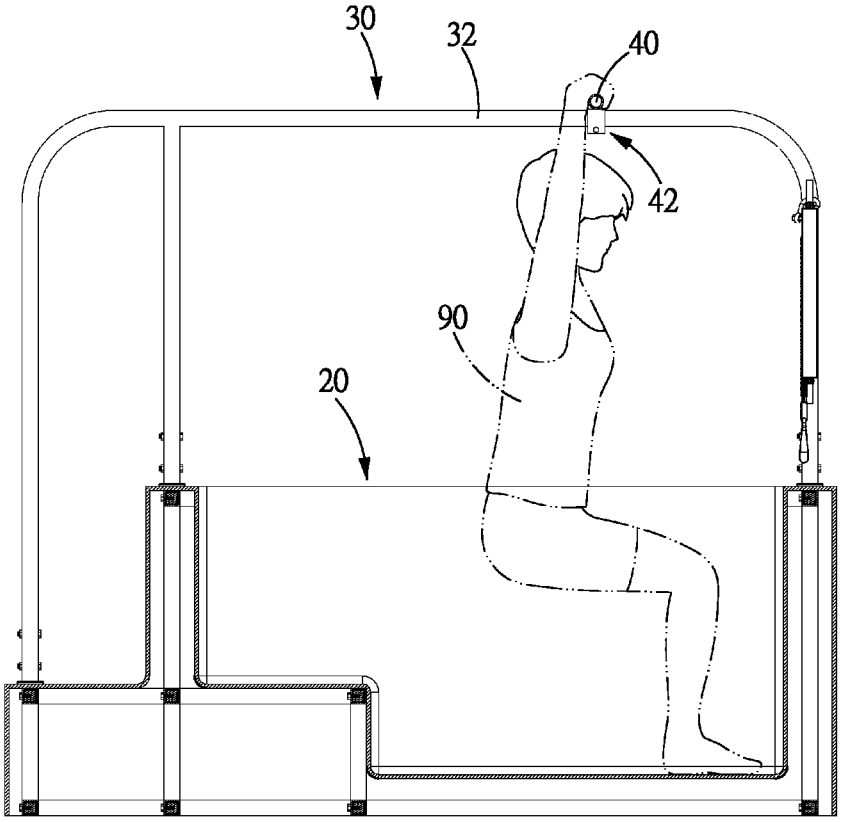
FIG. 6 is a third operational view of the bathtub exercise auxiliary apparatus in accordance with the first embodiment of the present invention.
Figure 7:
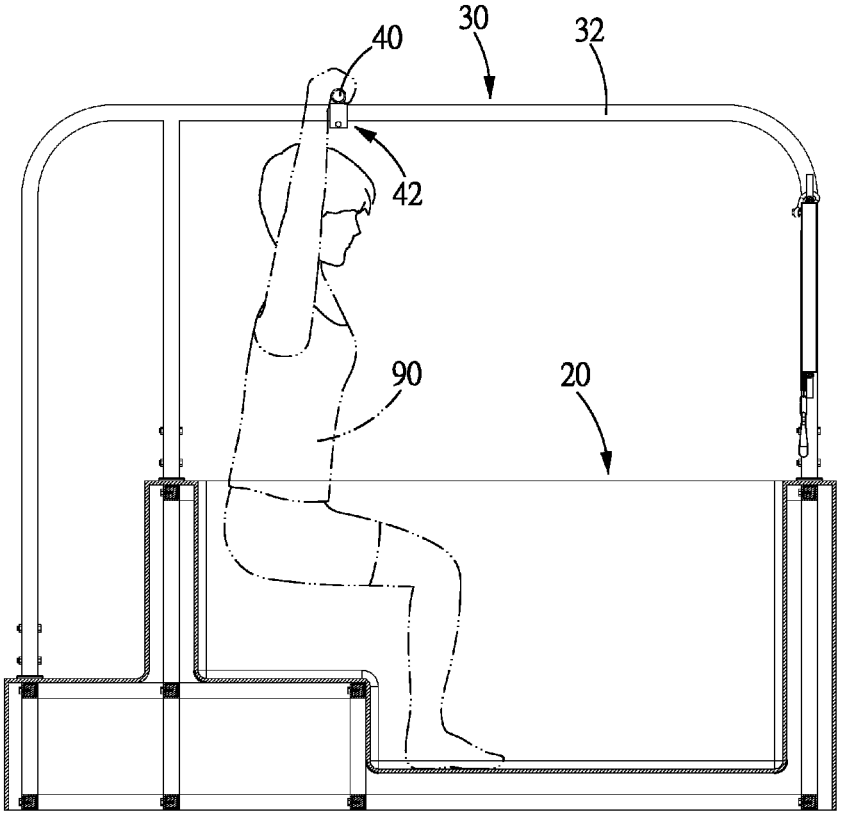
FIG. 7 is a fourth operational view of the bathtub exercise auxiliary apparatus in accordance with the first embodiment of the present invention.
Figure 8:
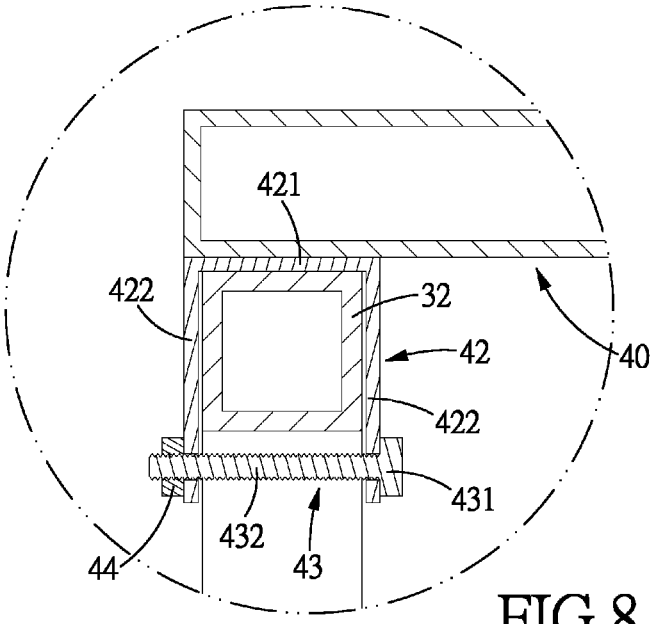
FIG. 8 is an enlarged view of a part of a bathtub exercise auxiliary apparatus in accordance with a second embodiment of the present invention.
Figure 9:
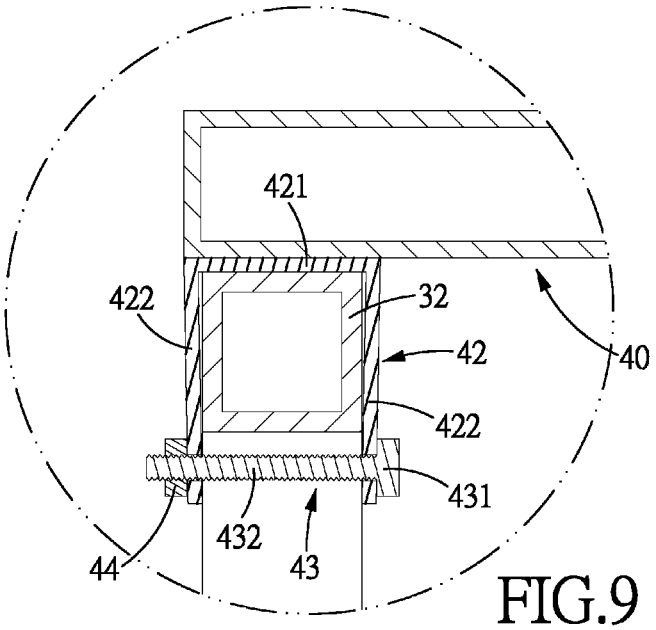
FIG. 9 is another enlarged view of the bathtub exercise auxiliary apparatus in accordance with the second embodiment of the present invention.

Referring then to FIGS. 2 and 6-8, a bathtub exercise auxiliary apparatus in accordance with a second embodiment of the present invention is similar to the first embodiment, except that:

The exercise rack 40 is movably disposed between the two traverse connecting rods 32 of the second support 30 and includes two positioning units 42 for clamping and releasing the two traverse connecting rods 32. As shown in FIG. 8, when the positioning units 42 release the traverse connecting rods 32, the exercise rack 40 will be free to move along the two traverse connecting rods 32, just as shown in FIGS. 6 and 7, which show the status of the exercise rack 40 before and after movement. As shown in FIG. 9, when the positioning units 42 clamp the traverse connecting rods 32, the exercise rack 40 will be fixed on the two traverse connecting rods 32, and therefore can be gripped by the user 90. In this embodiment, the positioning units 42 each include a traverse positioning portion 421 for abutting against the top of the traverse connecting rods 32, and two lateral positioning portions 422 connected to the traverse positioning portion 421 and located at two sides of a corresponding one of the traverse connecting rods 32. The two lateral positioning portions 422 can be moved toward each other to clamp the traverse connecting rods 32, or moved away from each other to release the traverse connecting rods 32. Each of the positioning units 42 further includes a screw 43 and a nut 44. The screw 43 has a head portion 431 pressed against one of the lateral positioning portions 422 and a shaft portion 432 inserted through the two lateral positioning portions 422 and then screwed with the nut 44.

While we have shown and described various embodiments in accordance with the present invention, it is clear to those skilled in the art that further embodiments may be made without departing from the scope of the present invention.

What is claimed is:

1. A bathtub exercise auxiliary apparatus comprising: a first support including a plurality of base rods, a plurality of traverse support rods, a plurality of longitudinal support rods disposed between the base rods and the traverse support rods, and a plurality of longitudinal assembling rods connected to the longitudinal support rods; a bathtub covering the first support and including a trough and a plurality of housing portions, and the longitudinal assembling rods protruding out of and upwardly extending from the housing portions, wherein the housing portions press against the traverse rods; a second support removably fixed to the first support, located above the bathtub, and including a plurality of longitudinal connecting rods fixed to the longitudinal assembling rods, two parallel and spaced apart traverse connecting rods connected to the longitudinal connecting rods, two traverse rods connected between the longitudinal connecting rods, and two longitudinal rods connected to the traverse rods, wherein each of the longitudinal connecting rods of the second support includes an engaging groove for engaging with the longitudinal rods, an annular pressing portion is formed at a bottom of each of the longitudinal connecting rods of the second support to press against the housing portions of the bathtub; at least one traction unit for being pulled by the user being disposed at connections of the longitudinal rods and the traverse rods; and an exercise rack disposed between the traverse connecting rods of the second support, bridging over the trough, and including a griping portion; the bathtub exercise auxiliary apparatus being characterized in that:

each of the longitudinal connecting rods of the second support extends upward from a top surface of the bathtub, the two traverse connecting rods and the exercise rack are disposed above the bathtub and located a distance above the top surface of the bathtub.

2. The bathtub exercise auxiliary apparatus as claimed in claim 1 further comprising a screw and a nut, and the screw has a head portion pressed against the longitudinal connecting rod and a shaft portion inserted through the longitudinal connecting rod, the engaging groove, and the longitudinal assembling rod and then screwed with the nut.

3. The bathtub exercise auxiliary apparatus as claimed in claim 1, wherein the exercise rack is movably disposed between the two traverse connecting rods of the second support and includes two positioning units for clamping and releasing the two traverse connecting rods, when the positioning units release the traverse connecting rods, the exercise rack will be free to move along the two traverse connecting rods, and when the positioning units clamp the traverse connecting rods, the exercise rack will be fixed on the two traverse connecting rods.

4. The bathtub exercise auxiliary apparatus as claimed in claim 3, wherein the positioning units each include a traverse positioning portion for abutting against the top of the traverse connecting rods, and two lateral positioning portions connected to the traverse positioning portion and located at two sides of a corresponding one of the traverse connecting rods, the two lateral positioning portions are able to move toward each other to clamp the traverse connecting rods, or move away from each other to release the traverse connecting rods, each of the positioning units further includes a screw and a nut, and the screw has a head portion pressed against one of the lateral positioning portions and a shaft portion inserted through the two lateral positioning portions and then screwed with the nut.

5. The bathtub exercise auxiliary apparatus as claimed in claim 1, wherein the two traction units each include an engaging portion for engaging with the connection of the longitudinal rods and the traverse rods, a spring connected to the engaging portion, and a handle connected to the spring.

6. The bathtub exercise auxiliary apparatus as claimed in claim 1 further comprising a screen disposed on the longitudinal rods and the traverse rods.

* * * * *